US006948534B1

(12) United States Patent
Hirz

(10) Patent No.: US 6,948,534 B1
(45) Date of Patent: Sep. 27, 2005

(54) APPARATUS FOR FILLING CHARGED AEROSOL CANS

(76) Inventor: Donald J. Hirz, 835 Charles St., Willowick, OH (US) 44095

( * ) Notice: Subject to any disclaimer, the term of this patent is extended or adjusted under 35 U.S.C. 154(b) by 0 days.

(21) Appl. No.: 10/847,054

(22) Filed: May 17, 2004

(51) Int. Cl.[7] ..... B65B 1/04
(52) U.S. Cl. ..... 141/20
(58) Field of Search ..... 141/3, 20, 67

(56) References Cited

U.S. PATENT DOCUMENTS 3,797,534 A * 3/1974 Skidmore ..... 141/3
5,143,165 A * 9/1992 Hough ..... 177/59
D361,581 S 8/1995 Hirz
5,535,790 A 7/1996 Hirz
5,647,408 A 7/1997 Erste et al.
5,740,841 A 4/1998 Hirz
5,832,965 A 11/1998 Fasse et al.
6,138,720 A 10/2000 Zeigler

* cited by examiner

*Primary Examiner*—Steven O. Douglas
(74) *Attorney, Agent, or Firm*—Pearne & Gordon LLP

(57) ABSTRACT

Filling apparatus for female valve type precharged aerosol cans includes an improved check valve construction that effectively reduces leakage and blow back while being both simple and economical. The valve comprises a seat formed of PTFE in the configuration of an O-ring. A can carrier assembly below the filling head supports the can in coupled relation with the filling head. The can carrier utilizes a relatively short compression spring to lift the can into its coupled relationship with the filling head and to laterally stabilize the lower end of the can without auxiliary guides and the like such that the carrier avoids the need for extraneous manipulation of elements other than the can itself when the can is being loaded or unloaded into the apparatus and the carrier cannot be jammed by spilled material.

12 Claims, 3 Drawing Sheets

APPARATUS FOR FILLING CHARGED AEROSOL CANS

BACKGROUND OF THE INVENTION

The invention relates to improvements in apparatus for filling aerosol cans.

PRIOR ART

Various devices have been created to inject paint or other material into aerosol cans precharged with solvent and propellant on a custom or other low volume basis. Examples of prior art devices are disclosed, for example, in U.S. Pat. Nos. 5,535,790; 5,647,408; 5,740,841; 5,832,965; and D361,581. Some devices have exhibited a tendency to allow propellant to leak back from a can and, in some cases, are susceptible to "blow back". In the latter case, where significant leakage flow occurs in an injector circuit, paint or other material in a reservoir on the filling device is uncontrollably expelled by propellant in the aerosol can. This phenomena is the result of large pigment particles or dry paint particles fouling a valve seat or valve ball in the injector circuit and thereby preventing a leak proof seal being established between these valve members.

Relative axial movement is ordinarily necessary to couple an aerosol can filling/dispensing opening or port to the filling device. In prior art devices, the injector, along with a superjacent reservoir, is fixed above a can receiving zone. The can is supported in the receiving zone from below on a platform that is vertically moveable toward and away from the injector. Various actuating/guiding mechanisms have been used to elevate and lower the can supporting platform and move the can axially into or out of coupling relation with the injector. These prior art can supporting/transporting mechanisms typically comprise numerous elements that add cost to the manufacture of the can filling device. Additionally, prior art can supporting and transporting mechanisms can be subject to fouling and malfunction when an accidental spill of paint or other material occurs. The parts associated with the mechanism may be difficult to reach and/or disassemble for purposes of cleaning up an accidental spill.

SUMMARY OF THE INVENTION

The invention provides an aerosol can filling device that is economical to produce, easy to use, and reliable in operation. The device includes an improved filling head with a valve seat construction that avoids critical surface machining in the injector valve seat area while affording a leak and blow back resistant valve operation. This improved valve operation is obtained through the use of a simple O-ring confined in an associated annular pocket. The O-ring forms the seat for a spring biased valve ball. The relatively soft nature of the O-ring, its surface geometry, and material characteristics, for yet unexplained reasons, effectively reduces the occurrence of leaks and blow back from a precharged aerosol can.

The filling device includes a simplified can support that enables the operator to load or unload a can to or from a coupled relationship with the filling head by simple gripping and manipulation of the can without requiring extraneous movements of levers or other operating elements. In the disclosed embodiment, the can support is mounted directly on a large diameter, heavy wire spring which is the exclusive locating element for the can support. The spring serves to guide and laterally stabilize the can support without reliance on bearing surfaces, linkages, levers, or the like. As a beneficial consequence, accidental spills of paint or other materials being dispensed into aerosol cans cannot interfere with the function of the support and can be cleaned up without disassembly and/or up-ending the device.

DESCRIPTION OF THE PREFERRED EMBODIMENT

Figure 1:
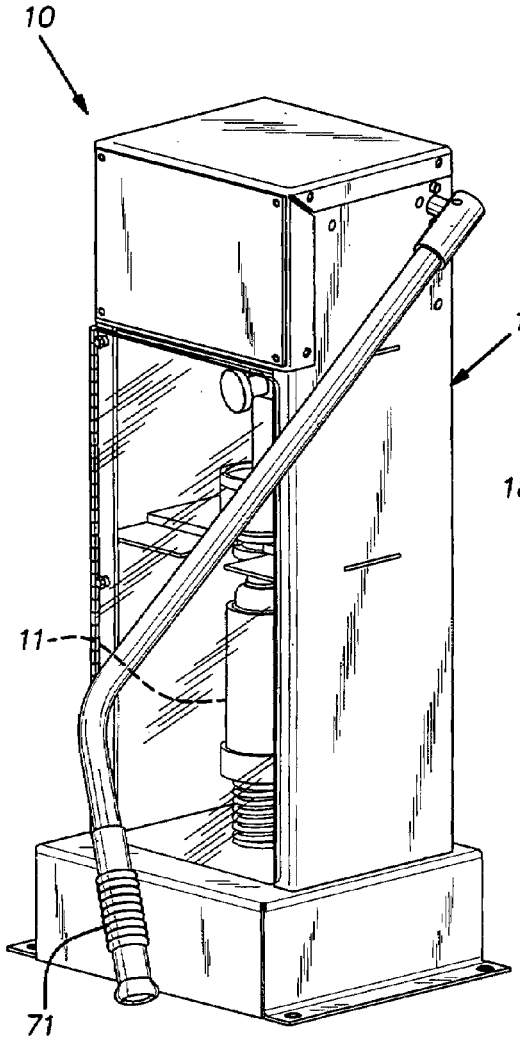
FIG. 1 is a perspective view of an aerosol can filling device embodying the invention.
Figure 2:
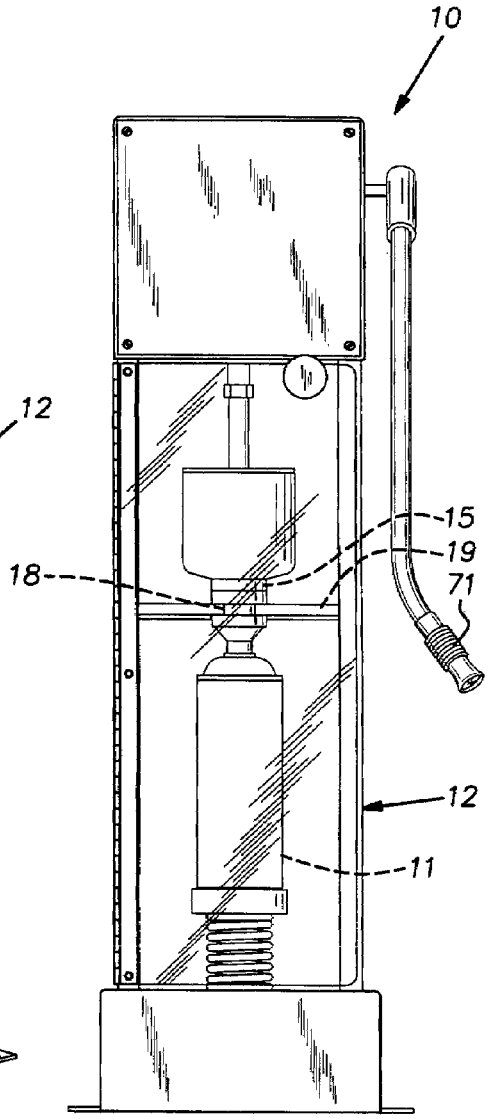
FIG. 2 is a front elevational view of the device.

Referring now to the drawings and particularly to FIGS. 1 and 2, there is shown an aerosol can filling device 10 for injecting paint or other liquid material into an aerosol can 11 that is prefilled typically with a solution of a liquid solvent and gas propellant. The device 10 includes a rectangular housing or frame 12 preferably constructed of sheet steel. Details of the housing construction and mechanical elements within the housing are disclosed in U.S. Pat. No. 5,535,790, the disclosure of which is incorporated herein by reference.

Figure 3:
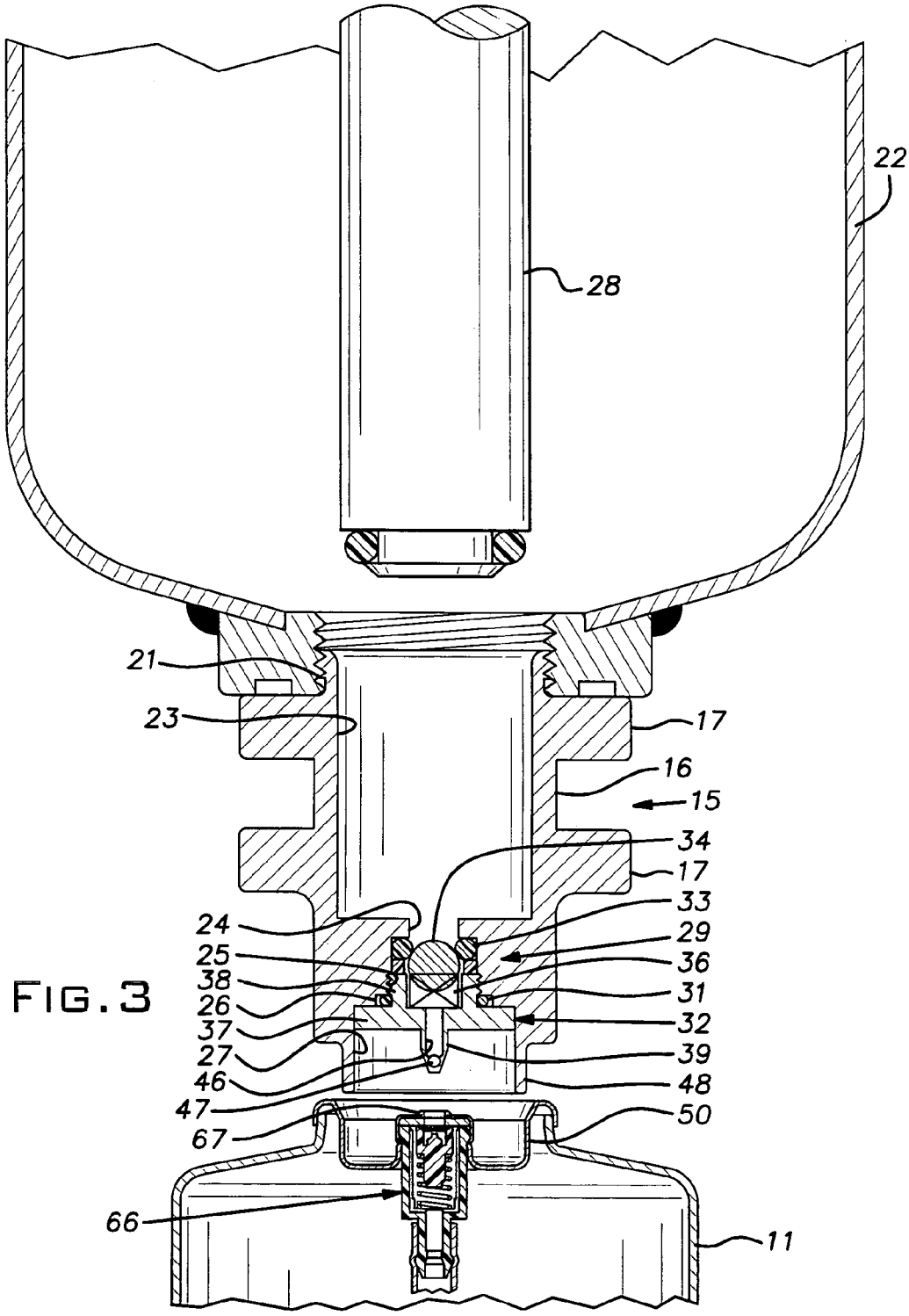
FIG. 3 is a cross-sectional view of a filling head of the device taken in a vertical mid-plane.
Figure 4:
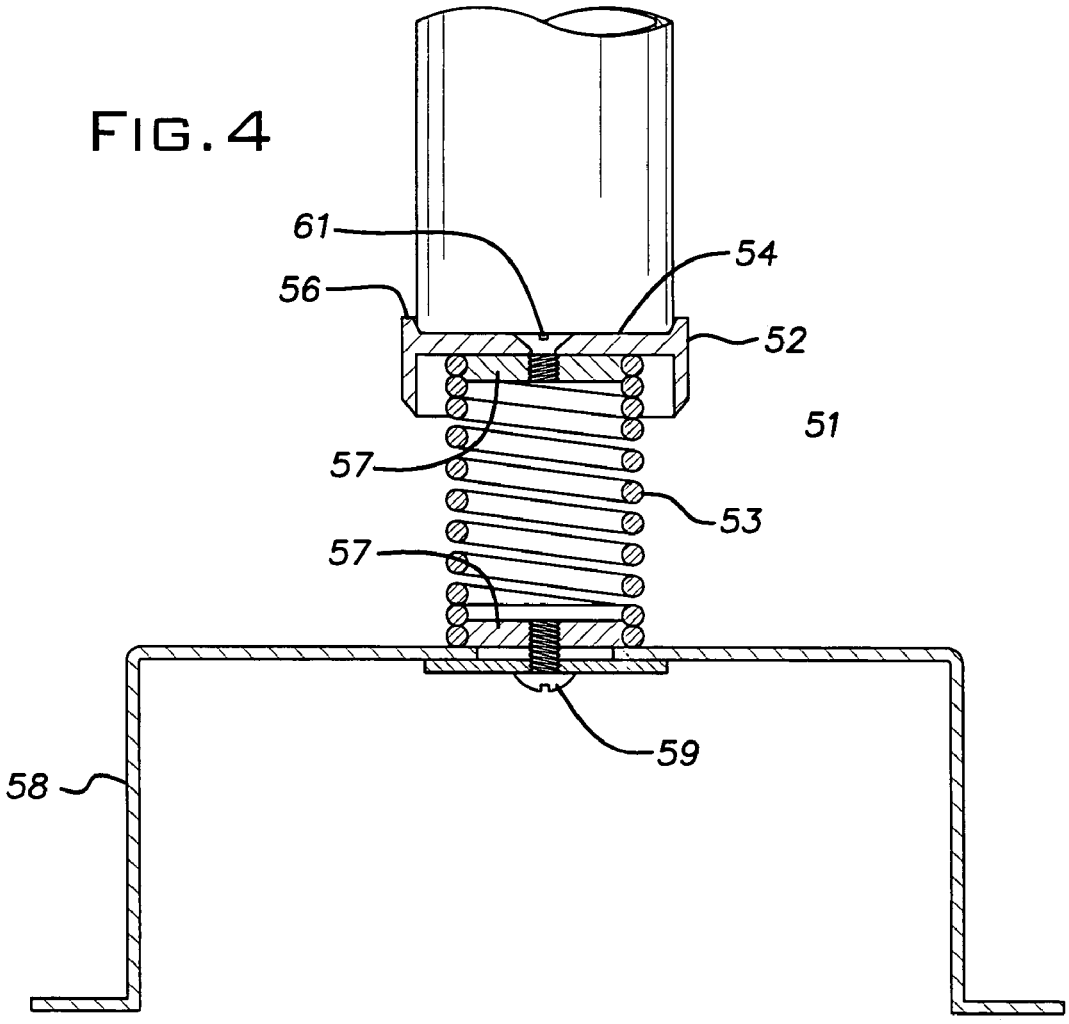
FIG. 4 is a cross-sectional view of a can support platform taken in a vertical mid-plane coincident with the plane of FIG. 3.

The device 10 includes a filling head assembly 15 shown in cross-section in FIG. 3. The filling head assembly 15 includes a cylindrical body 16 having axially spaced, radially extending round flanges 17 which vertically locate the head assembly in a slot 18 in a horizontal support plate 19 carried in the frame 12. The body 16 is preferably formed of aluminum and anodized with hard coat type 3. At an upper end, the body 16 has external threads 21 to couple the body with a cup-like reservoir 22. The body 16 is formed with a series of bores 23–27 coaxial with the body and interconnected so as to allow passage of fluid through the body as described below.

A major bore 23 at an upper end of the body 16 forms a cylinder for a piston 28. A minor bore 24 at the lower end of the piston cylinder bore 23 leads to a valve assembly 29 in an intermediate bore 25. A shallow bore 26 at the lower end of the intermediate bore 25 receives an O-ring seal 31 for a filling nozzle 32 received in a lower bore 27 and the intermediate bore 25.

The valve assembly 29 includes a seat 33, a ball 34, and a compression spring 36 for biasing the ball into sealing contact with the seat.

The filling nozzle 32 is a circular, integral body, having as coaxial elements, a main disc-like element 37, an upwardly extending circular skirt 38, and a depending hollow projecting pin or injector 39. The exterior of the skirt 38 is threaded and mates with internal threads at the lower end of the intermediate bore 25. The O-ring 31 is assembled on the base of the skirt 38 where it joins the main disc 37 and is received in the shallow bore 26 when the nozzle skirt 38 is threaded into the intermediate bore 25 and an upper face of the disc 37 abuts a radial surface at the end of the bore 27. The disc 37 has a pair of blind holes (not shown), on a common diametral line, in its lower face to enable it to be turned in or out of assembly with the body 16 using a suitable spanner wrench. In assembly, the valve spring 36 and a portion of the ball 34 are received in the interior of the nozzle skirt 38. A washer-like retaining ring 44, preferably of metal, is assembled between the upper end of the nozzle skirt 38 and the seat 33 and has a clearance bore to enable the ball 34 to move freely with respect to the seat.

The seat 33 has the configuration of an O-ring, i.e. that of a toroid described by the rotation of a circle rotated about an axis lying in the plane of the circle and spaced from it. The seat 33, is preferably a commercially available product. The seat 33 is formed of a suitable plastic material which is resistant to solvents and chemicals ordinarily used with materials being injected into an aerosol can. Preferably, the seat is constructed of polytetrafluoroethylene (PTFE) such as that marketed under the registered trademark Teflon®. In the illustrated example, the seat 33 is made of PTFE and has a nominal OD of 7/16" and an ID of 1/4 while the valve ball is 17/64" in diameter. The nozzle disc 37 and injector pin 39 have a common central bore; a cross bore 47 adjacent the lower end of the injector pin 39 intercepts and provides a fluid outlet or exhaust for the bore 46.

A carrier assembly 51 raises and supports an aerosol can 11 to a position for receiving a charge of liquid material from the filling head 15. The carrier assembly 51 includes a circular support platform 52 and a compression spring 53. The platform 52 has an inverted round cup shape. At its upper periphery, an end wall 54 of the platform 52 has an annular lip 56 adapted to laterally or radially constrain the bottom of an aerosol can. A pair of spring mounts 57 secure opposite ends of the spring 53. The spring mounts 57 are relatively short circular bodies having helical grooves on their peripheries that are configured to receive the inside of the end coils of the spring 53 by tightly threading into the same. The mounts 57 are fixed to the underside of the platform 52 and a base 58 of the frame 12 with suitable screws 59, 61 in coaxial alignment with the filling head assembly 15.

The relatively large diameter of the spring being, for instance, about 2¼" in OD and a major fraction of its free length of about 3", combined with a wire diameter of, for instance, about 0.148" yields a construction that gives the spring the ability to adequately stabilize the platform 52, biasing it to a vertical axis orientation coaxial with the filling head.

In use, an aerosol can 11 is manually placed on the platform 52 while the can is tilted so that its bottom fits within the lip 56 and its upper or dispensing end accommodates the filling head assembly 15. The can 11 is manually depressed moving the platform 52 downwardly against the force bias of the spring 53. When the can 11 is low enough, it is rotated upright and the support or carrier assembly 51 is allowed to lift the can so that its upper end receives a depending alignment collar or skirt 48 on the lower portion of the filling head assembly 15. When the alignment collar 48 slips into the recess of a cap 50 crimped onto the upper end of the can 11 and thereby laterally locates the upper end of the can, a female valve 66 at a central port 67 on the cap 50 of the can couples with the injector pin or connector 39.

It will be understood that the can loading motion can be manually accomplished with one or both hands of a person operating the device 10 without the need to grasp or manipulate extraneous elements such as levers, knobs and so-forth. With paint or other liquid material in the reservoir 22, a handle 71 can be operated back and forth to reciprocate the piston 28 in and out of the major bore cylinder 23 to inject the material into the can 11 through the injector pin 39. An example of a suitable mechanism for driving the piston 28 through the handle 71 is given in aforementioned U.S. Pat. No. 5,535,790. A downward stroke of the piston 28 hydraulically opens the valve assembly 29 by the force of the pressure against the ball 34 which is sufficient to overcome the bias force of the spring 36. The spring 53 of the carrier assembly 51 is proportioned to hold the can 11 against the filling head assembly 15 with between about seven to ten pounds of force.

It will be seen that the spring 53 is the exclusive guide and restraining member for the can support platform 52. This arrangement avoids slides, guides, or bearing surfaces, or linkages and, thereby, eliminates the risk that dry paint from an accidental spill will prevent operation of the can support carrier assembly 51.

When the desired quantity of liquid material has been injected into the can 11, the can is removed simply by manually gripping it, depressing it against the force of the spring 53, and tilting it out from under the filling head assembly 15. The can 11 is thus released and may be taken away from the filling head assembly and the device 10 altogether.

It has been discovered that PTFE is an ideal material for the seat 33. Besides being chemically inert, this material adapts to the surface of the sealing ball so as to form a reliable seal with the ball. While the reason or reasons are not presently understood, the PTFE seat has virtually eliminated the problem of blow back. This phenomena of blow back occurs occasionally with prior filling devices when the ball is arranged to contact a metal seat surface and course ground pigment or dry paint particles prevent seating of the metal surfaces. The disclosed PTFE O-ring seat, in combination with the valve ball, has a self-purging action which has been discovered to effectively eliminate this blow back phenomena.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A device for filling precharged aerosol cans with a liquid comprising a frame, a filling head carried on the frame, a can support assembly carried on the frame and spaced below the filling head, the head including a passage for delivering liquid from a reservoir and a connector for coupling the passage with a port on a can to be filled, a valve in the passage for controlling fluid flow therethrough, the can support including a compression spring having a lower end fixed to the frame and an upper end adapted to maintain a can in a position to be coupled with the connector by applying an upward vertical force on the can, the spring being capable of exclusively providing lateral guidance for upward movement of a lower end of the can between a can loading position and a connector coupling position.

2. A device as set forth in claim 1, wherein the head includes an alignment skirt coaxial with said connector, said alignment skirt being arranged to laterally locate an upper end of a can.

3. A device as set forth in claim 2, wherein the alignment skirt is arranged to fit within a cap crimped on the can and carrying said port.

4. A device as set forth in claim 1, wherein the spring has an outside diameter at least as great as one-half its free length.

5. A device as set forth in claim 1, wherein the spring is proportioned to apply an upward vertical force on the can of about between 7 to 10 pounds when the can is in the coupling position.

6. A device as set forth in claim 1, wherein said head includes an injector pin adapted to enter a female valve port of a can and said spring develops a sufficient force in the coupling position to maintain said can coupled to said injector pin during filling operation of said device free of supplemental support.

7. A manually operated device for filling precharged aerosol cans with liquid comprising a filling head having a piston cylinder and an injector for fluid coupling with a female valve port on the can, a liquid discharge circuit to the injector, a check valve assembly in the discharge circuit for passing liquid from the piston cylinder to the aerosol can and preventing fluid flow from the aerosol can when the injector is coupled to the aerosol can including a ball and a PTFE seat sealed by direct contact of the ball when the valve assembly is closed, said seat being in the form of an O-ring, said O-ring having the form of a toroid defined by the revolution of a circle about an axis from which it is spaced and which lies in its plane, the diameter of the ball being smaller than the average of the OD of the O-ring seat and the ID of the O-ring seat.

8. A device as set forth in claim 7, including a compression spring biasing said ball against said seat.

9. A device as set forth in claim 7, wherein said filling head includes a body formed of aluminum and said seat is disposed in a bore in said body.

10. A device as set forth in claim 7, including a can support coaxial with said injector, said can support including a platform for supporting the bottom of a can to be filled and a spring below said platform.

11. A device as set forth in claim 10, wherein said spring is disposed between said platform and a base of a frame of said device.

12. A device as set forth in claim 11, wherein said filling head includes a guide for laterally stabilizing the upper end of an aerosol can when the can is being loaded into a position for coupling between said injector and said female valve port on the can.

* * * * *